United States Patent [19]

Couwenbergs et al.

[11] Patent Number: 4,744,190

[45] Date of Patent: May 17, 1988

[54] SPACING RETAINER INCLUDING LOCKING MEANS FOR REINFORCEMENTS

[76] Inventors: Paul Couwenbergs, Scheibenbergstrasse 17, 7500 Karlsruhe, Netherlands; Andreas Holterhus, Hauptstrasse 21, 4441 Spelle, Fed. Rep. of Germany

[21] Appl. No.: 943,179

[22] PCT Filed: Mar. 7, 1986

[86] PCT No.: PCT/EP86/00121

§ 371 Date: Nov. 4, 1986

§ 102(e) Date: Nov. 4, 1986

[87] PCT Pub. No.: WO86/05538

PCT Pub. Date: Sep. 25, 1986

[30] Foreign Application Priority Data

Mar. 11, 1985 [DE] Fed. Rep. of Germany ... 8506996[U]

[51] Int. Cl.[4] ..... E04C 5/18; E04C 5/06

[52] U.S. Cl. ..... 52/650; 52/652; 52/687; 52/688; 52/689

[58] Field of Search ..... 52/650, 652, 687, 688, 52/689

[56] References Cited

U.S. PATENT DOCUMENTS

| | | | |
|---|---|---|---|
| 1,674,204 | 6/1928 | Johnson | 52/650 |
| 3,289,378 | 12/1968 | Carroll | 52/688 |
| 3,444,663 | 5/1969 | Hehn | 52/650 |

FOREIGN PATENT DOCUMENTS

| | | | |
|---|---|---|---|
| 1484104 | 12/1968 | Fed. Rep. of Germany | 52/689 |
| 1509036 | 12/1968 | Fed. Rep. of Germany | 52/687 |
| 2312054 | 9/1974 | Fed. Rep. of Germany | 52/652 |
| 3229488 | 3/1983 | Fed. Rep. of Germany . | |
| 2113903 | 6/1972 | France . | |
| 691542 | 10/1979 | U.S.S.R. | 52/687 |

*Primary Examiner*—Alfred C. Perham

*Attorney, Agent, or Firm*—Lee, Smith & Zickert

[57] ABSTRACT

The spacing retainer contains spacer elements comprising a multiple number of interconnected angle elements and locking elements. The locking elements are lockingly connected with a first structural steel fabric by means of locking parts at their free ends. A second structural steel fabric is held at a spacing from the first structural steel fabric by means of the series-arranged and side-by-side arranged spacer elements. The spacer elements comprise struts for their reinforcement.

14 Claims, 3 Drawing Sheets

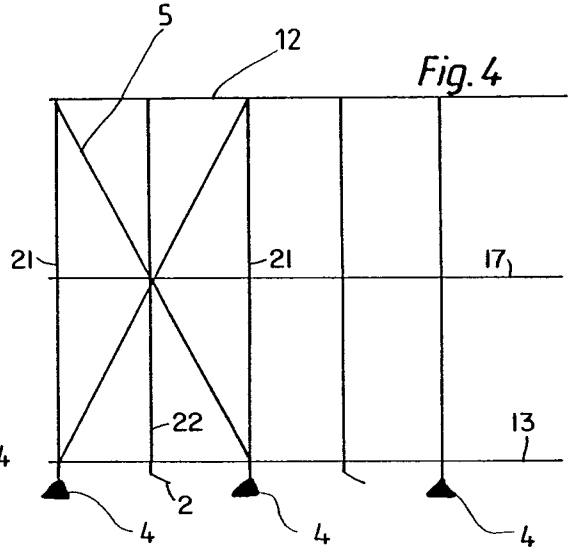
Fig. 4
5
12
21
22
17
13
2
4
4
4
21
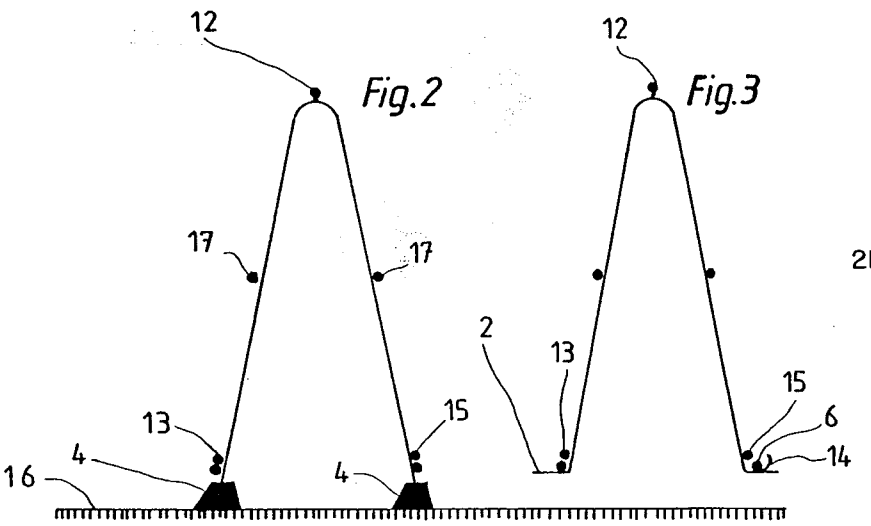
Fig. 3
12
13
2
15
6
14
Fig. 2
12
17
17
13
4
4
15
16

SPACING RETAINER INCLUDING LOCKING MEANS FOR REINFORCEMENTS

TECHNICAL FIELD

The invention relates to a spacing retainer for a reinforcement containing two structural steel fabrics arranged parallel to and spaced from each other.

BACKGROUND ART

Known spacing retainers are arranged between the structural steel fabrics in order to hold such structural steel fabrics at a predetermined spacing from each other. In such arrangements the spacing retainers are not sufficiently firmly arranged in many cases so that the spacing retainers fall over under the loads which frequently occur during concrete construction, and can no longer fulfill their purpose. However, it is indispensable for the reinforcement that the structural steel fabrics remain maintained in their relative positions until solidification of the concrete.

DISCLOSURE OF INVENTION

It is the object of the invention to provide a spacing retainer which is sufficiently firmly arranged between the structural steel fabrics and maintains the predetermined spacing between the structural steel fabrics even under load.

According to the invention this object is achieved in that the spacing retainer contains a plurality of series-arranged and juxtaposed spacer elements which are lockingly connected with a first structural steel fabric of the reinforcement and which hold a second structural steel fabric at a spacing from the first structural steel fabric.

The inventive spacing retainers can be mounted in a simple manner because the spacer elements in their compressed state can be introduced between adjacent members or elements of the first structural steel fabric and the locking connection is produced simply by release. The locking connection results in a sufficiently firm arrangement of the spacer elements between the first and the second structural steel fabrics which are thereby reliably retained at their predetermined spacing even under loads.

BRIEF DESCRIPTION OF DRAWINGS

Exemplary embodiments of the inventive spacing retainer are illustrated in the drawings and explained and described in detail hereinbelow with reference to the reference characters. There are shown in FIG. 1 a perspective view of a reinforcement containing the inventive spacing retainers;

FIG. 2 a view of an angle element in the assembled state in a spacer element of the reinforcement shown in FIG. 1;

FIG. 3 a view of a locking element in the assembled state in a spacer element of the reinforcement shown in FIG. 1;

FIG. 4 a side view of a modified construction of a spacer element in the reinforcement shown in FIG. 1.

PREFERRED MODES FOR CARRYING OUT THE INVENTION

Figure 1:
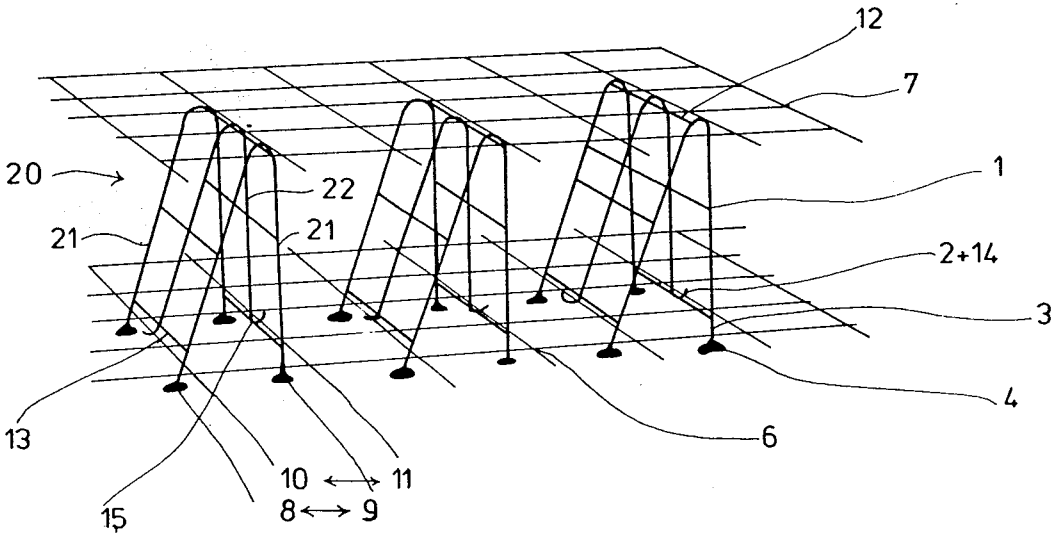
Figure 5:
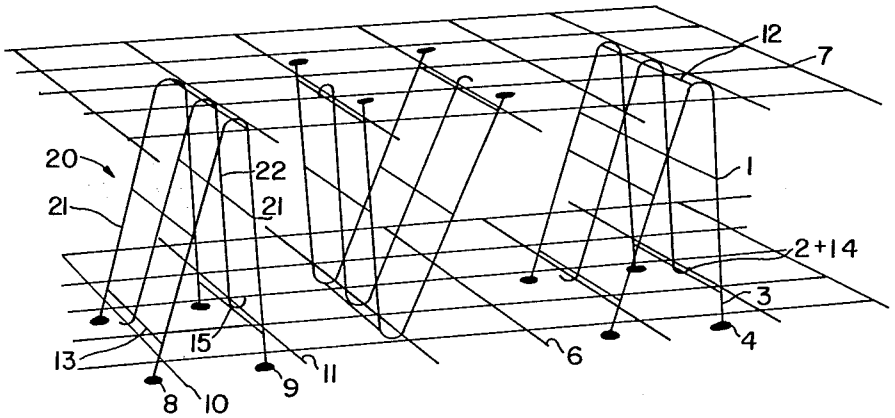
FIG. 5 a perspective view of another form of a reinforcement containing the inventive spacing retainers.

FIG. 1 schematically shows in perspective view a section of a reinforcement for concrete as building material. Such reinforcement consists of a first, namely bottom structural steel fabric 6 and a second, namely top structural steel fabric 7 which are arranged in a spaced relationship to each other in a substantially parallelly extending manner and which are held spaced from each other by means of spacing retainers. The spacing retainers are formed of spacer elements 20 which are arranged in rows in series and side by side.

The spacer elements 20 are constructed from resilient material, particularly reinforcing steel such that they can be mounted in particularly simple manner. In the illustrated exemplary embodiment each spacer element 20 consists of two angle elements 21 and a central angle element which is arranged therebetween and constructed as a locking element 22. Depending on the conditions and requirements of the respective purpose of use, there can also be selected a different numerical ratio between the angle elements 21 and the locking elements 22.

The angle elements 21 and the locking element 22 enclose substantially the same angle which is adapted to the respective case of use or the spacings present in the first structural steel fabric 6. In detail, the locking element 22 in this arrangement is constructed such that it locks to two adjacent elements 10 and 11 of the first structural steel fabric 6. The angle elements 21 and the locking element 22 are interconnected at their tops by means of a strut in the form of a steel rod 12 and close to their free ends by struts in the form of steel rods 13 and 15.

The free ends of the angle elements 21, see FIG. 2, are provided with respective protective devices consisting of plastic bases 4 in the illustrated exemplary embodiment. The free ends of the angle elements 21 bear upon a casing 16 by means of the plastic bases 4. In this arrangement the plastic bases 4 not only prevent the free ends of the angle elements 21 from penetrating into the casing 16 which consists of wood in most cases, but furthermore prevent corrosion of the angle elements 21 at the protruding free ends.

The locking element 22 is provided with respective locking parts at its free ends and the locking parts produce the locking connection between the spacer element 20 and the first structural steel fabric 6. In the exemplary embodiment illustrated on the right in FIG. 3, the locking parts are formed by the free ends 14 of the locking element 16 which are bent in a hook-shape. In the construction shown on the left in FIG. 3, the locking parts can be formed by bent-off locking parts 2 of the locking element 22. Therein the free ends are bent off such that, after locking to the adjacent elements 10 and 11 of the first structural steel fabric 6, the locking parts do not extend parallel to this structural steel fabric but at an angle directed towards this structural steel fabric 6.

For assembly, the space elements 20 are compressed such that the free ends of the locking elements 22 with the locking parts 2 or 14 are through-passed between the adjacent elements 10 and 11 of the first structural fabric 6; the plastic bases 4 of the angle elements 21, then, bear upon the casing 16. During release, the locking parts 2 or 14 of the locking element 22 grip under the adjacent elements 10 and 11 of the first structural steel fabric 6. Due to the bending of the free ends of the locking element 22 to form the locking parts 2 or 14, such locking parts are located at a plane above the casing 16, so that, after attachment of the spacer elements 20, the first structural steel fabric 6 is elevated from the casing 16. The construction of the locking parts 2 or 14 ensures that the spacer elements 20 remain safely connected with the first structural steel fabric 6 when the reinforcement is loaded on the side of the second structural steel fabric 7 because the spreading of the locking elements 22 during the application of such load does not result in a separation of the locking parts 2 or 14 from the associated elements 10 and 11 of the first structural steel fabric 6.

In the assembled state of the spacer elements 20 each of the adjacent elements 10 and 11 of the structural steel fabric 6 is located between the associated locking part 2 or 14 of the locking element 22 and the associated steel rod 13 or 15 which interconnects the angle elements 21 and the locking element 22 close to their free ends.

For additional reinforcement, the spacer elements 20 may contain further struts or steel rods 17 or 5 which interconnect the adjacent angle elements 21 of each spacer element 20 either laterally or diagonally in the region between the top and the free ends, see FIG. 4. The second structural steel fabric 7 may be connected in conventional manner with the tops of the spacer elements 13.

The locking elements 22 of the different spacer elements 20 also may be arranged in a modification of the exemplary embodiment illustrated in FIG. 1 such that the locking elements 22 within each row of spacer elements 20 are alternatingly lockingly connected with the first structural steel fabric 6 and the second structural steel fabric 7. The arrangement also may be such that adjacent rows of spacer elements 20 contain locking elements 22 which are lockingly connected with the first structural steel fabric 6 in one row and with the second structural steel fabric 7 in the adjacent row.

We claim:

1. A spacer element of a space element arrangement for retaining a reinforcement containing two structural steel fabrics arranged parallel to and spaced from each other, said spacer element comprising:

a predetermined number of angle elements made of a resilient material and defining a top and free ends;

at least one locking element made of resilient material and defining a top and free ends;

a strut interconnecting said predetermined number of angle elements and said at least one locking element at said tops thereof;

struts interconnecting said predetermined number of angle elements and said at least one locking element close to the free ends and on predetermined sides thereof;

each one of said free ends of said at least one locking element being bent in a predetermined direction from said predetermined side of said at least one locking element such as to form a locking part for forming a locking connection with an associated member of an associated one of the two structural steel fabrics;

each one of said structs which interconnect said predetermined number of angle elements and said at least one locking element close to said free ends and on predetermined sides thereof, extending on one of said predetermined sides of said at least one locking element and from which one predetermined side said locking parts is bent off; and each one said locking parts of said at least one locking element and an associated one of said struts cooperating such that said associated member of said associated structural steel fabric is locked between said locking part and said cooperating associated strut.

2. The spacer element as defined in claim 1, wherein:

said at least one locking element contains two free ends;

each one of said two free ends being bent such as to form said locking part; and said locking parts cooperating with respective associated struts such that associated ones of two adjacent parallel members of said associated structural steel fabric are locked by said two locking parts of said at least one locking element.

3. The spacer element as defined in claim 1, wherein:

each said locking part constitutes a hook-shaped locking part.

4. The spacer element as defined in claim 1, wherein:

each said locking part bent in said predetermined direction, is bent such as to extend at an angle directed towards said associated structural steel fabric having said associated member which is locked by said locking part in the assembled state of said spacer element and said associated structural steel fabric.

5. The spacer element as defined in claim 1, wherein:

said free ends of said predetermined number of angle elements extend beyond said locking parts of said at least one locking element; and each one of said free ends of said predetermined number of angle elements is provided with a protective device.

6. The spacer element as defined in claim 5, wherein:

said protective device contains a plastic base; and said plastic base is irreleasably connected with its associated free end for supporting said free end of said angle element at a casing.

7. The spacer element as defined in claim 1, wherein:

said predetermined number of angle elements constitutes two angle elements;

said at least one locking element constitutes one locking element; and said one locking element is arranged intermediate said two angle elements.

8. The spacer element as defined in claim 1, wherein:

said at least one locking element constitutes a predetermined number of locking elements; and said locking elements and said angle elements are alternatingly arranged and interconnected in series.

9. The spacer element as defined in claim 8, wherein:

each one of said further struts extends substantially diagonally between said top and close to said free end of adjacent ones of said predetermined number of angle elements.

10. The spacer element as defined in claim 1, further including:

further struts interconnecting said predetemined number of angle elements and said at least one locking element.

11. The spacer element as defined in claim 10, wherein:

said further struts extend between said strut interconnecting said angle elements and said at least one locking element at their tops and said struts which interconnect said angle elements and said at least one locking element close to said free ends and on said predetermined sides thereof.

12. A spacer element arrangement for retaining a reinforcement containing two structural steel fabrics arranged parallel to and spaced from each other, said spacer element arrangement comprising:

a plurality of spacer elements;

said plurality of spacer elements forming a predetermined number of adjacent rows of series-arranged spacer elements;

each one of said spacer elements being lockingly connected to a first one of the two structural steel fabrics for holding a second structrual steel fabric spaced from said first structural steel fabric and from a casing;

each one of said spacer elements comprising:

a predetermined number of angle elements made of a resilient material and defining a top and free ends;

at least one locking element made of resilient material and defining a top and free ends;

a strut interconnecting said predetermined number of angle elements and said at least one locking element at said tops thereof;

struts interconnecting said predetermined number of angle elements and said at least one locking element close to the free end and on predetermined sides thereof;

said free ends of said at least one locking element being bent in respective predetermined directions from respective one of said predetermined sides of said at least one locking element such as to form respective locking parts for forming respective locking connections with respective associated members of said first structural steel fabrics;

each one of said struts which interconnect said predetermined number of angle elements and said at least one locking element close to said free ends and on predetermined sides thereof, extending on one of said predetermined sides of said at least one locking element and from which one predetermined side said locking parts is bent off;

and each one of said locking parts of said at least one locking element and an associated one of said struts cooperating such that said associated member of said associated structural steel fabric is locked between said locking part and said cooperating associated strut.

13. The spacer element arrangement as defined in claim 12, wherein:

said spacer elements in each one of said predetermined number of rows of series-arranged spacer elements are arranged such that said at least one locking element of said series-arranged spacer elements alternatingly form locking connections with said associated members of said first structural steel fabric and associated members of said second structural steel fabric.

14. The spacer element arrangement as defined in claim 12, wherein:

adjacent rows of series-arranged spacer elements form locking connections with the first structural steel fabric in one row and the second structural steel fabric in the adjacent row.

* * * * *